US011105587B2

(12) United States Patent
Hamilton et al.

(10) Patent No.: US 11,105,587 B2
(45) Date of Patent: Aug. 31, 2021

(54) TURRET WITH A ZERO STOP

(71) Applicant: Sheltered Wings, Inc., Middleton, WI (US)

(72) Inventors: David Hamilton, Middleton, WI (US); Michael Rosen, Middleton, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 588 days.

(21) Appl. No.: 15/416,157

(22) Filed: Jan. 26, 2017

(65) Prior Publication Data

US 2017/0211912 A1 Jul. 27, 2017

Related U.S. Application Data

(60) Provisional application No. 62/287,665, filed on Jan. 27, 2016.

(51) Int. Cl.
*F41G 1/44* (2006.01)
*F41G 1/38* (2006.01)

(52) U.S. Cl.
CPC ..... *F41G 1/44* (2013.01); *F41G 1/38* (2013.01)

(58) Field of Classification Search
CPC .. F41G 1/44; F41G 1/473; F41G 1/38; G05G 1/10
See application file for complete search history.

(56) References Cited

U.S. PATENT DOCUMENTS

| | | | | |
|---|---|---|---|---|
| 1,425,321 A | | 8/1922 | Etherington | |
| 2,608,000 A | | 8/1952 | Catiglia | |
| 2,699,141 A | | 1/1955 | Gaguski | |
| 2,811,894 A | | 11/1957 | Braker | |
| 3,037,287 A | | 6/1962 | Glatz et al. | |
| 3,095,750 A | | 7/1963 | Herbert | |
| 3,270,418 A | | 9/1966 | Simeone et al. | |
| 3,904,279 A | | 9/1975 | Sanada | |
| 3,930,720 A | | 1/1976 | Uesugi | |
| 3,990,155 A | | 11/1976 | Akin, Jr. | |
| 4,020,203 A | | 4/1977 | Thuler | |
| 4,247,161 A | * | 1/1981 | Unertl, Jr. ..... | G02B 27/36 359/424 |
| 4,285,137 A | | 8/1981 | Jennie | |
| 4,286,388 A | | 9/1981 | Ross et al. | |
| 4,373,269 A | | 2/1983 | Doliber et al. | |
| 4,554,745 A | | 11/1985 | Repa | |
| 4,806,007 A | | 2/1989 | Bindon | |
| 4,822,994 A | | 4/1989 | Johnson et al. | |
| 5,044,304 A | | 9/1991 | Tomita | |

(Continued)

FOREIGN PATENT DOCUMENTS

| | | |
|---|---|---|
| WO | 2010/077691 A2 | 7/2010 |
| WO | 2012119574 A1 | 9/2012 |
| WO | 2013158500 | 10/2013 |

OTHER PUBLICATIONS

Stoney Point Target Know, http://www.survivalmonkey.com/threads/stoney-points-target-knob-for-leupold.4380/., Oct. 17, 2006.

(Continued)

*Primary Examiner* — Thomas C Diaz

(74) *Attorney, Agent, or Firm* — Husch Blackwell LLP

(57) ABSTRACT

In one embodiment, the disclosure relates to a turret for a firearm. In another embodiment, the disclosure relates to a turret zero stop.

5 Claims, 9 Drawing Sheets

(56) References Cited

U.S. PATENT DOCUMENTS

| | | | | |
|---|---|---|---|---|
| 5,113,261 | A | 5/1992 | Morisawa | |
| RE34,059 | E | 9/1992 | Akitake | |
| 5,291,241 | A | 3/1994 | Hirano et al. | |
| 5,372,087 | A | 12/1994 | Kato et al. | |
| 5,414,595 | A | 5/1995 | Oike et al. | |
| 5,752,759 | A | 5/1998 | Pizzo | |
| 6,279,259 | B1 | 8/2001 | Otteman | |
| 6,351,907 | B1 * | 3/2002 | Otteman | F41G 1/38 42/120 |
| 6,499,191 | B1 | 12/2002 | Howie, Jr. | |
| 6,508,026 | B1 | 1/2003 | Uppiano et al. | |
| 6,608,272 | B2 | 8/2003 | Garcia | |
| 6,640,481 | B1 | 11/2003 | Williams, Jr. | |
| 6,643,970 | B2 | 11/2003 | Huber | |
| 6,691,447 | B1 | 2/2004 | Otteman | |
| 6,772,550 | B1 | 8/2004 | Leatherwood | |
| 6,860,224 | B2 | 3/2005 | Snider | |
| 6,862,832 | B2 | 3/2005 | Barrett | |
| 7,203,998 | B2 | 4/2007 | Howie, Jr. | |
| 7,415,791 | B2 | 8/2008 | Williams et al. | |
| 7,440,185 | B1 | 10/2008 | Thorpe et al. | |
| 7,578,091 | B2 | 8/2009 | Klepp et al. | |
| 7,612,952 | B2 | 11/2009 | Schafer | |
| 7,640,830 | B2 | 1/2010 | Bonis | |
| 7,793,456 | B1 | 9/2010 | Lacorte | |
| 7,827,725 | B1 | 11/2010 | Hagler | |
| 7,934,335 | B2 | 5/2011 | Halverson | |
| 7,937,879 | B2 | 5/2011 | Hamilton | |
| 7,958,665 | B2 | 6/2011 | Hamilton | |
| 7,997,163 | B2 | 8/2011 | Casas | |
| 8,006,429 | B2 | 8/2011 | Windauer | |
| 8,166,696 | B2 | 5/2012 | Hamilton | |
| 8,490,317 | B2 | 7/2013 | Adkins et al. | |
| 8,670,179 | B2 | 3/2014 | Windauer | |
| 8,919,026 | B2 | 12/2014 | Hamilton | |
| 8,928,878 | B2 | 1/2015 | Jaeschke et al. | |
| 8,984,796 | B2 | 3/2015 | Thomas et al. | |
| 9,677,848 | B2 | 6/2017 | Hamilton | |
| 9,958,235 | B2 * | 5/2018 | Lassak | F41G 1/38 |
| 2003/0131516 | A1 | 7/2003 | Blomdahl | |
| 2003/0192224 | A1 | 10/2003 | Kirk | |
| 2004/0088898 | A1 | 5/2004 | Barrett | |
| 2004/0144013 | A1 | 7/2004 | Leatherwood | |
| 2004/0148841 | A1 | 8/2004 | Burzel | |
| 2005/0201076 | A1 | 9/2005 | Marcelle et al. | |
| 2005/0252065 | A1 | 11/2005 | Scherpf | |
| 2006/0171136 | A1 | 8/2006 | Horoho | |
| 2007/0103884 | A1 | 5/2007 | Popowich et al. | |
| 2007/0137089 | A1 | 6/2007 | William et al. | |
| 2007/0175080 | A1 | 8/2007 | Sammut et al. | |
| 2007/0195513 | A1 | 8/2007 | Nishiyama et al. | |
| 2008/0023309 | A1 | 1/2008 | Montalvo | |
| 2008/0066364 | A1 | 3/2008 | Klepp et al. | |
| 2009/0205461 | A1 | 8/2009 | Windauer | |
| 2009/0241399 | A1 | 10/2009 | Hamilton | |
| 2010/0175298 | A1 | 7/2010 | Thomas et al. | |
| 2010/0229451 | A1 | 9/2010 | Hamilton | |
| 2011/0061285 | A1 | 3/2011 | Hamilton | |
| 2011/0100152 | A1 | 5/2011 | Huynh | |
| 2011/0102918 | A1 | 5/2011 | Windauer | |
| 2011/0242650 | A1 | 10/2011 | Windauer | |
| 2012/0186131 | A1 | 7/2012 | Windauer | |
| 2013/0167425 | A1 | 7/2013 | Crispin | |
| 2013/0276345 | A1 | 10/2013 | Hamilton | |
| 2015/0153138 | A1 | 6/2015 | Presley et al. | |
| 2015/0276348 | A1 | 10/2015 | Delaca et al. | |
| 2016/0025456 | A1 | 1/2016 | Hamm et al. | |

OTHER PUBLICATIONS

Schmidt & Bender 2011 catalog.

International Search Report dated Jul. 22, 2013 for International Appln. No. PCT/US2013/036427.

International Search Report and Written Opinion for International Appln. No. PCT/US2017/015041, dated Apr. 13, 2017, 10 pages.

Product Nightforce B.E.A.S.T.; website screenshot from www.nighttorceoptics.com/beast; obtained Dec. 3, 2014.

Product Kahles Multizero System; website screenshot from http//www.youtube.com/watch?v=LXwMPIwiSFQ obtained Dec. 3, 2014.

Product Meopta Ballistic Hunting Turret; website screenshot from http://www.meoptasportsoptics.com/en/ballistic-hunting-turret-installation-1404043008.html; obtained Dec. 3, 2014.

Extended European search report for EP 17205556.8 dated Jun. 15, 2018, 9 pages.

* cited by examiner

TURRET WITH A ZERO STOP

CROSS-REFERENCE TO RELATED APPLICATIONS

This application is a non-provisional application of and claims priority to U.S. Provisional Patent Application No. 62/287,665 filed Jan. 27, 2016, which is incorporated herein in its entirety.

FIELD

The disclosure relates to a turret for a firearm. In one embodiment, the disclosure relates to a turret with a zero stop.

BACKGROUND

Long range shooting has become more and more popular in the USA and around the world in the last decade. Forms of long range shooting include long range hunting, target shooting, competition, law enforcement, and military applications. As long range shooting becomes more popular shooters have become more proficient at shooting and the entire shooting industry has advanced.

One advancement in long range shooting over the past decade is the art of ballistics. As shooting has advanced shooters have desired to have a way to accurately compensate their crosshair for the true point of impact of a bullet at long range. This allows the user to place the crosshair directly on their intended point of impact without having to "hold over" the target for trajectory (or bullet drop) compensation. The way crosshair compensation is normally accomplished is through the turret system.

A turret is one of two or more dials on the outside center part of a riflescope body. Turrets are marked in increments and are used to adjust elevation and windage for points of impact change. Conventional turrets have markings on them that indicate how many clicks of adjustment have been dialed in on the turret, or an angular deviation, or a distance compensation for a given cartridge. A click is one tactile adjustment increment on the windage or elevation turret of a scope.

Turrets are normally marked at each graduation, starting with "0" and increasing as you dial the turret. Often, but not always, turrets can rotate more than one revolution. An example of a common turret would be a turret with 15 MOA of adjustment in one revolution of the turret, graduated in ¼ MOA increments, for a total of 60 positions (or click detents). The detent at each ¼ MOA increment is a clicker, which a person can usually both hear and feel as they click from one detent to the next. If a turret has 15 MOA of travel in one revolution a typical marking scheme on the turret would be to show each full MOA number with a hash mark, but at each intermediate ¼ MOA marking you would only have a hash mark with no number. As a result, the user would see 0 through 14 listed on the turret and 15 MOA would actually be a full rotation back to zero.

The disadvantage occurs if you need to dial more than 15 MOA into the turret. In this case, the user must go more than one revolution, and perform calculations to determine how many MOA have been dialed. For example, on turn 2 or revolution 2, if the turret is stopped at number 5, you would be at 20 MOA (15 MOA+5 MOA=20 MOA).

For very long range shots, one may need to dial 30 MOA or more compensation into the turret to adjust the crosshair appropriately for the bullet trajectory. One way to give enough travel in a turret would be to create a turret with 30 or more MOA of travel in one revolution of the turret. Another method would be to allow the turret to turn more than one revolution. It is not uncommon in the industry to see turrets with 3 or 4 or more revolutions before mechanically running out of total "travel" on the turret.

The advantage of having 30 MOA of travel in one revolution is that you are less likely to need more than one revolution of travel and therefore can simply look at the numbers and know where you dialed without having to do any calculations. The disadvantage to 30 MOA in one revolution is that for a given diameter of turret the ¼ MOA graduations are spaced closer together. Graduations of such close proximity make it difficult for a user to feel each individual click, and make it easier to "skip" over a click accidentally.

The only way to make the clicks feel better is to make the turret larger in diameter so that the mechanical detents are larger. However, for many scopes, this is a disadvantage because the goal is to keep a scope small, streamlined, and lightweight. Hunters, in particular, like more compact, lightweight riflescopes than tactical or competition shooters. Most hunting scopes have an ideal turret size, click feel, and travel per rotation, which means that somewhere around 15 MOA is usually the best amount of turret adjustment per turn.

In addition, it is common when installing a new riflescope onto a rifle to "zero" the rifle. There are also many smartphone apps and other devices that can aid a shooter in calculating their ballistic compensation for a given range and environment, which would be dialed into the turret. For example, a .308 caliber at a 1000 yard shot may need to have a 30 MOA compensation dialed into the turret to place the crosshair in the correct spot in the riflescope in order to compensate for the trajectory of the bullet. After shooting at a long range target, a shooter will normally dial the turret back down to the "0" position.

Another factor important to understand is that in many situations a shooter may be shooting at a target at long range and then another "target of opportunity" suddenly appears at close range. It is well documented and known that in "stressful" situations humans lose their ability for fine motor skills and mostly retain gross motor skill movement.

For the reasons discussed above, having a "zero stop" turret is a big advantage. Thus, there is a large need for a zero stop turret that can address these concerns.

SUMMARY

In one embodiment, the disclosure relates to a turret. In another embodiment, the disclosure relates to a turret with a zero stop. In still another embodiment, the disclosure relates to a zero stop for a turret that is extremely simple, has a limited number of parts, is easy to use and is set by the user, provides a very solid stop at the defined zero position, and is compact and lightweight.

The disclosure relates to a stop position for the turret of a firearm. In one embodiment, the firearm is a riflescope. In one embodiment, the riflescope is a super lightweight hunting riflescope. In one embodiment, the disclosure relates to a zero stop for a non-translational turret.

In one embodiment, the turret zero stop disclosed herein can be used in riflescopes for hunting, competition shooting, target shooting, law enforcement and military shooting situations.

In one embodiment, the disclosure relates to a device comprising: (a) a knob, (b) a ring with one or two tracks, wherein the one or two tracks are located on the top and/or bottom of the ring; and (c) a base, wherein at least one of the knob or base has a pin for insertion into the one or two tracks of the ring. In one embodiment, the device is a turret. In one embodiment, the device is a turret assembly.

In one embodiment, the disclosure relates to a turret comprising: a knob with a pin coupled to the bottom of said knob; a base with a pin coupled to the top portion of the base; and a stop ring with a concentric cam-track with terminated ends on each face of said stop ring, wherein the base pin rides in the concentric cam-track on the bottom of the zero stop ring, and the knob pin rides in the concentric cam-track on the top of the zero stop ring.

In another embodiment, the disclosure relates to a device comprising: a knob with a pin coupled to the bottom side of said knob; a base with a track or groove on the top side of the base; and a ring with a track or groove on the top side and a pin on the bottom side; wherein the knob pin rests in the track or groove on the top side of the ring and the pin on the bottom side of the ring rests in the track or grove on the top side of the base.

In yet another embodiment, the disclosure relates to a turret comprising: a knob with a track or groove coupled to the bottom side of said knob; a base with a pin on the top side of the base; and a ring with a pin on the top side and a track or groove on the bottom side; wherein the ring pin rests in the track or groove on the top side of the knob and the base pin rests in the track or grove on the bottom side of the ring.

In another embodiment, the disclosure relates to a rifle scope comprising: a scope body; a movable optical element defining an optical axis, the optical element being operably connected to the scope body; a turret having a screw operably connected to the optical element for adjusting the optical axis in response to rotation of the screw; the turret comprising (a) a knob, (b) a ring with one or two tracks, wherein the one or two tracks are located on the top and/or bottom of the ring; and (c) a base, wherein at least the knob or base has a pin for insertion into the one or two tracks of the ring.

In yet another embodiment, the disclosure relates to a rifle scope comprising: a scope body; a movable optical element defining an optical axis, the optical element being operably connected to the scope body; a turret having a screw operably connected to the optical element for adjusting the optical axis in response to rotation of the screw; the turret comprising: a knob with a pin coupled to the bottom side of said knob; a base with a track or groove on the top side of the base; a ring with a track or groove on the top side and a pin on the bottom side; wherein the knob pin rests in the track or groove on the top side of the ring and the pin on the bottom side of the ring rests in the track or grove on the top side of the base.

In still another embodiment, the disclosure relates to a rifle scope comprising: a scope body; a movable optical element defining an optical axis, the optical element being operably connected to the scope body; a turret having a screw operably connected to the optical element for adjusting the optical axis in response to rotation of the screw; the turret comprising: a knob with a track or groove coupled to the bottom side of said knob; a base with a pin on the top side of the base; a ring with a pin on the top side and a track or groove on the bottom side; wherein the ring pin rests in the track or groove on the top side of the knob and the base pin rests in the track or grove on the bottom side of the ring.

In one embodiment, a turret base could have a track or groove and the zero stop ring could have a fixed pin for insertion into the track or groove of the turret base.

In one embodiment, the turret knob could have a track or groove and the zero stop ring could have the fixed pin for insertion into the track or groove of the turret base.

In one embodiment, the disclosure relates to a riflescope turret to give a stop position for the turret at your close range zero position. This allows the shooter to quickly dial back to their zero position and the turret will stop at that position. This allows the user to find their zero by feel, which is advantageous in most shooting situations. In one embodiment, the shooter is able to find their zero by feel alone.

One advantage of the zero stop turret disclosed herein is that the zero stop can be used with a non-translational turret.

One advantage of the turret disclosed herein is that it allows for more than one turn or rotation.

One advantage of the turret disclosed herein is that the turret does not rely on a straight cam track.

One advantage of the turret disclosed herein is that the turret does not rely on a "wedding cake" shaped pin moving in a cam track.

One advantage of the zero stop turret disclosed herein is that the zero stop is much simpler, smaller, and lighter than most zero stops on the market.

One advantage of the zero stop turret disclosed herein is the simplicity of the turret.

One advantage of the zero stop turret disclosed herein is that it does not require substantial mechanics, which makes the zero stop turret disclosed herein lighter in weight, simpler to use, an easier manufacture protocol, and inexpensive.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

Figure 1A:
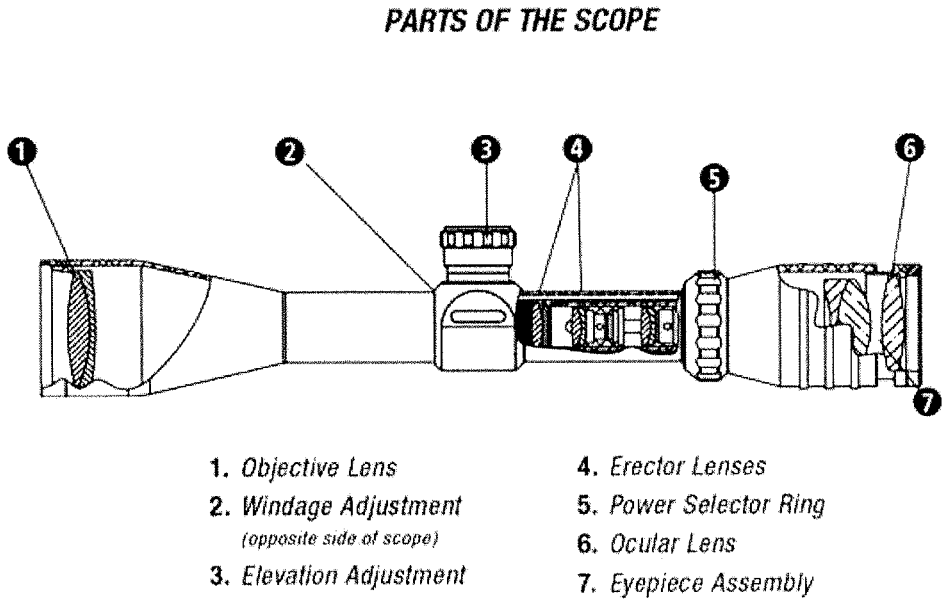
FIG. 1A illustrates various representative parts of a scope.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, melt index, temperature etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, relative amounts of components in a mixture, and various temperature and other parameter ranges recited in the methods.

As used herein, "ballistics" is a way to very precisely calculate the trajectory of a bullet based on a host of factors.

As used herein, "trajectory" is a bullet flight path over distance that is affected by gravity, air density, bullet shape, bullet weight, muzzle velocity, barrel twist direction, barrel twist rate, true bearing of flight path, vertical angle of muzzle, wind, and a number of other miscellaneous factors.

As used herein, a "turret" is typically a rotary dial on the riflescope. There are usually an elevation turret and windage turret. The elevation turret adjusts the crosshair vertically and the windage turret adjusts the crosshair horizontally. The elevation and windage turret, used in conjunction, can move the riflescope crosshair the proper amount to compensate for the bullet trajectory over range.

A turret typically has detent increments so that you can dial the precise amount of compensation. The turret detents are typically graduated in Minutes of Angle (MOA) or Milliradians (MRAD), which are angular units of measure that can be correlated to the amount of trajectory change in the bullet over range. Both MOA and MRAD can be used and are akin to the difference between using inches vs. centimeters to measuring distance.

A "translational" turret translates along the screw axis while it's being dialed. For example, an elevation turret would physically rise and lower as it was being dialed just like a screw into wood rises and lowers as it is screwed in and out of wood.

A "non-translational" turret has a mechanism inside that couples the outer turret knob to the inner turret screw so that from the outside as you dial the turret it appears the turret does not rise and lower as you dial, however, inside the turret there is a screw that is raising and lowering as you dial. This inner turret screw is pushing the mechanics and hence the reticle or crosshair is moved to the proper position as you dial. A non-translational turret is usually more compact, streamlined, and pleasing to the eye since it does not raise and lower as its dialed.

As used herein, a "reticle," in one embodiment, is a crosshair aiming point for your bullet. As used herein, a "reticle" is an aiming pattern for your bullet.

As used herein, zeroing means that you adjust your turrets so that your crosshairs are right on your intended point of bullet impact, with the turret adjusted to the "0" position at a prescribed range, usually 100 yards. As targets present themselves beyond 100 yards, a shooter would dial their turret "up" from the "0" position to compensate based off of readily known ballistic math.

As used herein, a zero stop is a mechanism that allows the user to set a mechanical stop in their turret after they have zeroed their rifle at 100 yards, or whatever they desire for their "zero" range. In this situation if you shoot a target at 900 yards and then a target appears suddenly at 100 yards, the user can simply dial the turret "down" until the turret mechanically stops against the zero stop. The user does not have to worry about watching the numbers on the turret, counting turns, and trying to stop at a fine click position at their original zero position. This allows the user to rely on feel only and gross motor skills rather than fine motor skills.

In one embodiment, the disclosure relates to a turret with a zero stop. In one embodiment, the turret is a body of two-piece construction with a top section and a bottom section. In one embodiment, the turret has a zero stop ring located between the top section and the bottom section. In another embodiment, the zero stop ring has, on each face, a concentric cam-track with terminated ends. The terminated ends on each side of the cam-track can be offset slightly.

Figure 1B:
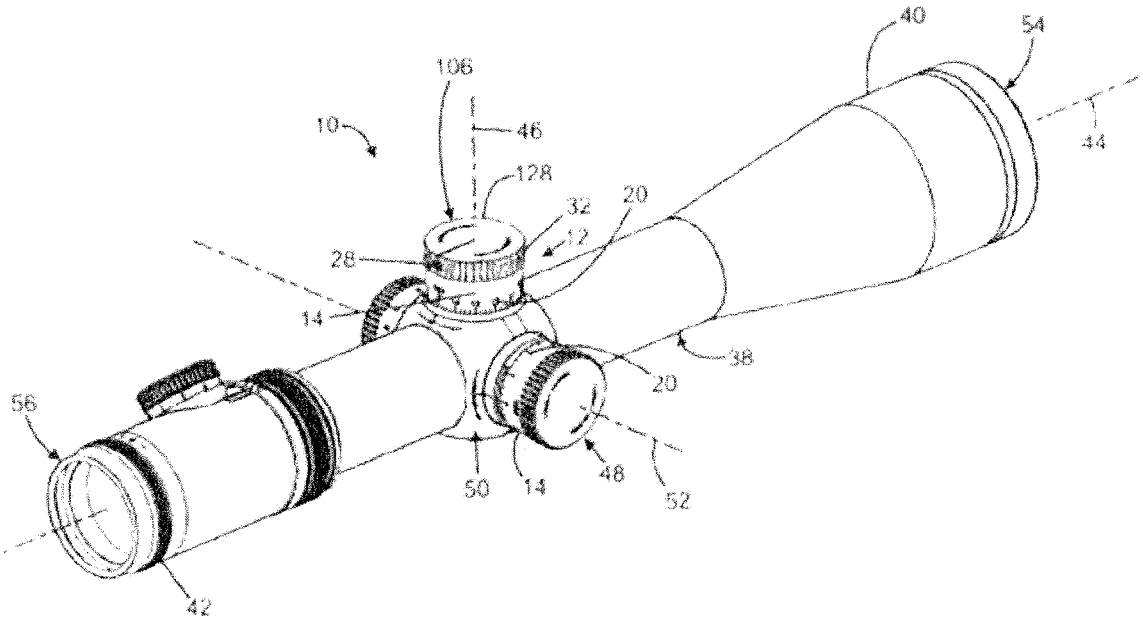
FIG. 1B illustrates an exemplary viewing optic in the form of a scope in accordance with embodiments of the present disclosure.

FIG. 1A illustrates various parts of a riflescope. FIG. 1B illustrates an exemplary viewing optic 10 in accordance with embodiments of the present disclosure. Specifically, FIG. 1B illustrates a scope. More particularly, the rifle scope 10 has a scope body 38 that encloses a movable optical element, which is an erector tube. The scope body 38 is an elongate tube tapering from a larger opening at its front 40 to a smaller opening at its rear 42. An eyepiece 56 is attached to the rear of the scope body, and an objective lens 54 is attached to the front of the scope body. The center axis of the movable optical element defines the optical axis 44 of the rifle scope.

An elevation turret 12 and a windage turret 48 are two dials in the outside center part of the scope body 38. They are marked in increments by indicia 20 on their perimeters 14 and are used to adjust the elevation and windage of the movable optical element for points of impact change. These dials protrude from the turret housing 50. The turrets are arranged so that the elevation turret rotation axis 46 is perpendicular to the windage turret rotation axis 52.

The movable optical element is adjusted by rotating the turrets one or more clicks. As the turret is rotated, a turret screw moves in and out of the scope, which pushes the erector tube. The erector tube is biased by a spring so when the turret screw is adjusted, it locates the erector tube against the bottom face of the turret screw. The erector tube provides a smaller view of the total image. As the erector tube is adjusted, the position of the reticle is modified against the image.

A click is one tactile adjustment increment on the windage or elevation turret of the rifle scope, each of which corresponds to an indicium 20. One click may change a scope's point of impact by ¼ inch at 100 yards, but a click may take on other values, such as ½ inch, OA milliradian, etc. In the illustrated embodiment, one click equals ¼ Minute of Angle. Minute of Angle (MOA) is a unit of measurement of a circle, which is 1.0472 inches at 100 yards. Conventionally, it is referred to as being 1 inch at 100 yards, 2 inches at 200 yards, 5 inches at 500 yards, ½ inch at 50 yards, etc.

In one embodiment, the disclosure relates to a turret comprising: (1) a turret knob with a pin; (2) a zero stop ring with a groove or track on both sides; and (3) a turret base with a pin, wherein the zero stop ring is located between the turret knob and the turret base.

In one embodiment, the disclosure relates to a turret assembly comprising: (1) a turret knob with a pin; (2) a zero stop ring with a groove or track on both sides; and (3) a turret base with a pin, wherein the zero stop ring is located between the turret knob and the turret base.

Figure 2:
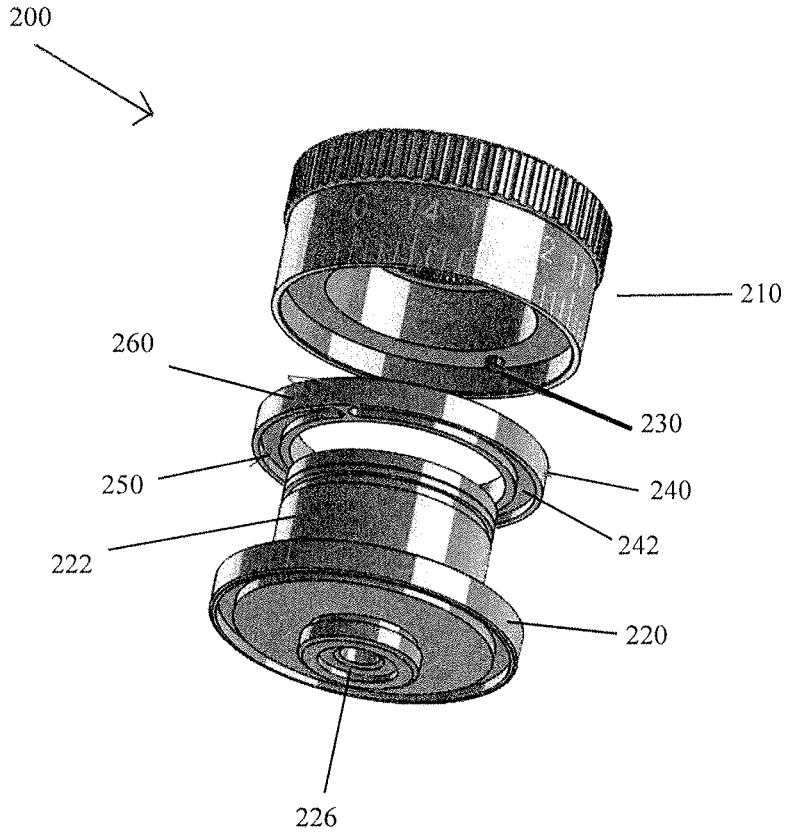
FIG. 2 is a representative exploded view of the turret zero stop disclosed herein. The zero stop ring is shown with a cam-track having terminated ends. The turret knob and the turret knob pin are shown. Also shown is the turret base.

FIG. 2 illustrates an exploded view of a turret 200 disclosed herein. More particularly, the turret 200 is a cylindrical body of two-piece construction with a top portion 210 and a bottom portion 220. In one embodiment, the top portion is a turret knob 210. In another embodiment, the bottom portion is a turret base 220. In one embodiment, the top portion and the bottom portion can be coupled together by threads.

In one embodiment, the turret base 220 can have a central portion 222. In another embodiment, the turret base can have a hollow, circular interior for insertion of a device, such as a screw. The turret base 220 can have an opening 226 at the bottom for insertion of a device, including but not limited to a screw. In one embodiment, the screw is a turret screw.

In one embodiment, the turret knob 210 has a circular shape adapted to fit to the turret base 220. The turret knob 210 has a turret knob pin 230. In one embodiment, the turret knob pin 230 is located at the bottom of the turret knob 210. In one embodiment, the turret knob pin 230 is located on an interior perimeter of the turret knob 210. The outer portion of the turret knob 210 can have indications or markings.

As shown in FIG. 2, the turret has a ring 240 located between the turret knob 210 and the turret base 220. In one embodiment, the ring 240 slides or fits over the central portion 222 of the turret base 220. The ring 240 can compress tightly against the central portion 222 of the turret base 230. In another embodiment, there is a gap between the ring 240 and the central portion 222 of the turret base.

In one embodiment, ring 240 can be a zero stop ring. In one embodiment, the circumference of the zero stop ring is at least 85 mm. In another embodiment, the circumference of the zero stop ring is at least 90 mm. In still another embodiment, the circumference of the zero stop ring is at least 90.47 mm.

In another embodiment, the circumference of the zero stop ring is selected from the group consisting of: from 80 to 95 mm, or from 85 to 95 mm, or from 90 to 95 mm.

Figure 3:
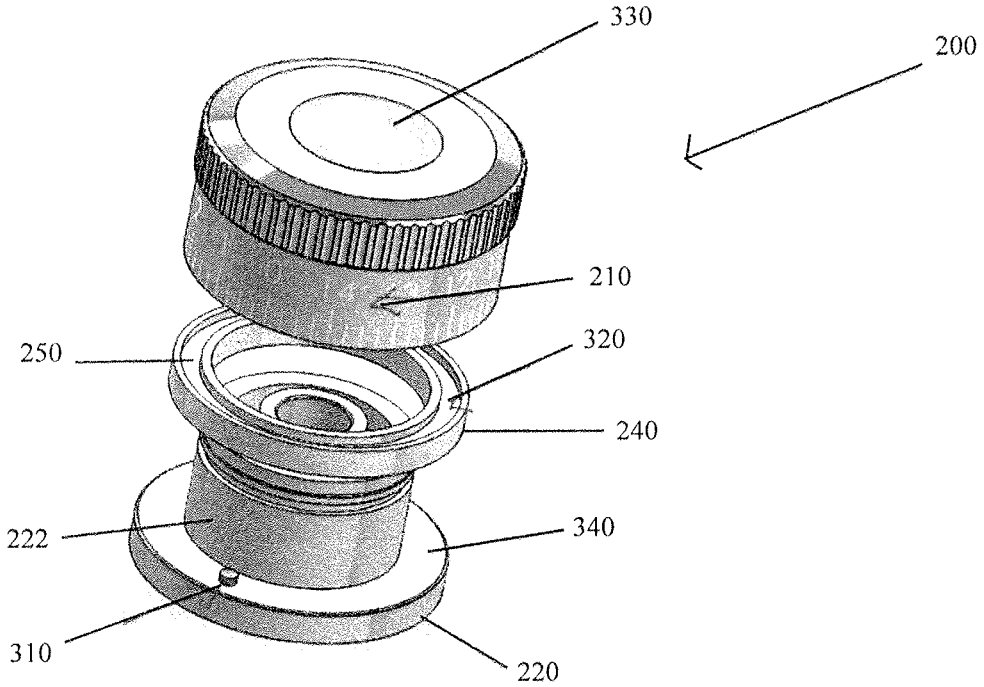
FIG. 3 is a representative exploded top view of the turret disclosed herein. The turret base pin is visible as well as the concentric cam-track with terminated ends.

In one embodiment, the ring 240 has a cam-track 250 with a top portion (as shown in FIG. 3) and a bottom portion 242. In one embodiment, the ring 240 has a cam-track on each side. In one embodiment, the cam-track 250 is concentric.

In another embodiment, the cam track 250 has terminated ends 260. In one embodiment, the terminated ends are off-set. In another embodiment, the terminated ends 260 are off-set to allow maximum rotation of the knob.

In one embodiment, the diameter of the track or grove is selected from the group consisting of: 18, 19, 20, 21, 22, 23, 24, 25, 26, 27, 28, 29, 30, 31, 32, 33, 34, 35, and greater than 35 mm.

In another embodiment, the diameter of the track or grove is at least 18 mm, or at least 20 mm, or at least 23 mm, or at least 25 mm.

In still another embodiment, the diameter of the track or grove is selected from the group consisting of: from 18 to 30 mm, or from 20-30 mm, or from 23-30 mm, or from 25-30 mm.

FIG. 3 is another exploded view of the turret 200. The turret base 220 has a turret base pin 310. In one embodiment, the turret base pin 310 is located at the top 340 of the turret base 220. A percentage of the turret base pin 310 can extend above the top 340 of the turret base 320 including but not limited from 5-10%, or from 10-20%, or from 20-30%, or from 30-40%, or from 40-50%, or from 50-60%, or from 60-70%, or from 70-80%, or greater than 80%.

The ring 240 has a concentric cam-track 250 with terminated ends 260 on each side. A track or groove 320 is located on the top side of the ring 240. The turret knob 210 can have an outer turret cap 330.

Figure 4:
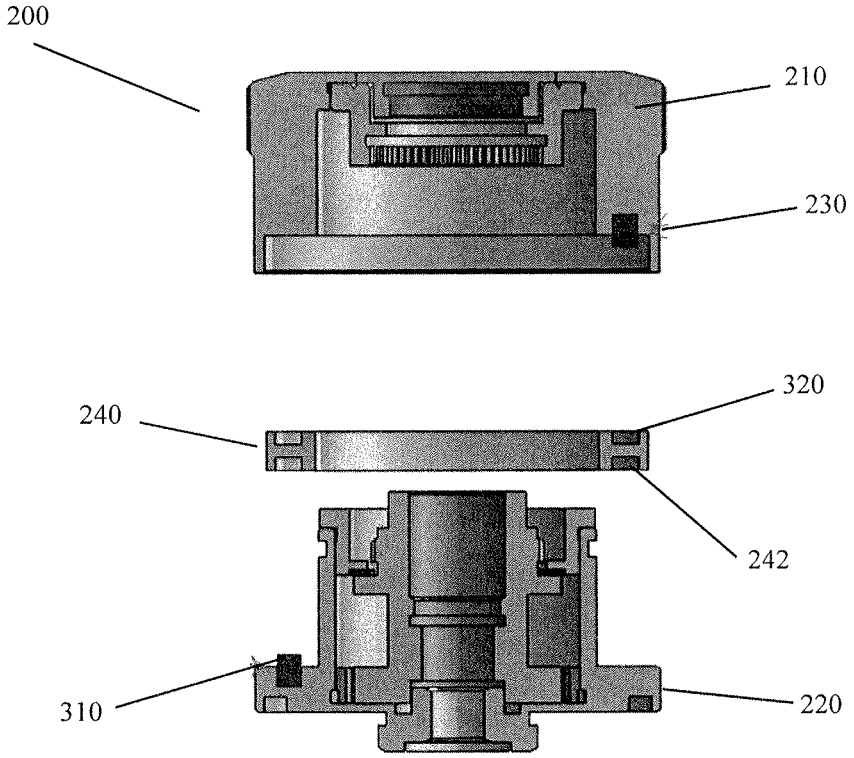
FIG. 4 is another exploded cross-section view of the turret disclosed herein. The zero stop ring, the base pin and the knob pin are visible.

FIG. 4 is another exploded view showing the turret knob 210, the knob pin 230, the turret base 220 and the turret base pin 310, and the ring 240, which functions as zero stop ring. The ring 240 has a top track 320 and a bottom track 242.

In one embodiment, the base pin 310 of the base turret 220 rides in the concentric cam track 250 on the bottom side 242 of the ring 240, and the turret knob pin 230 rides in the concentric cam-track 250 on the top side 320 of the ring 240.

In one embodiment, the terminated ends 260 of the cam-track 250 are slightly offset, which allows the turret knob 210 to travel in one full rotation while the knob pin 230 rides in the top track without rotating the zero stop ring 240.

Once the knob pin 230 reaches the terminated end of the stop ring cam track 250, the turret knob 210 and zero stop ring 240 will rotate together with the base pin 310 riding in the concentric cam track on the bottom side 242 of the zero stop ring 240, which allows almost a full second revolution of the turret.

Figure 5:
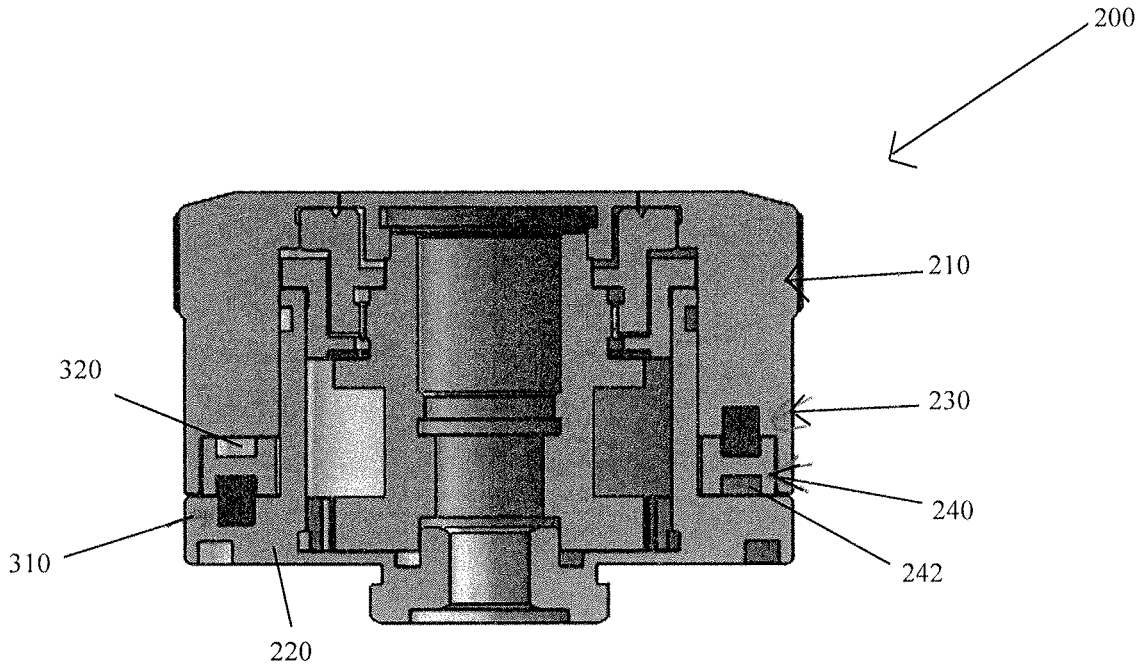
FIG. 5 is a representative cut-away view of the turret disclosed herein. The knob pin resting in the top track of the zero stop ring is shown. The turret base pin resting in the bottom track of the zero stop ring is also shown.

FIG. 5 is an assembled cut-away view of the turret 200. The turret knob pin 230 rests inside the top track 320 or top side 320 of the zero stop ring 240. The turret base pin 310 rests inside the bottom track 242 or bottom side 242 of the zero stop ring 240. Due to the terminated ends 260, a full second turn is almost accomplished, which provides nearly 30 MOA of travel in almost 2 turns on a turret. The above set-up allows great detent click feel because it only has 15 MOA of travel per turn.

The design described above is light-weight, compact, simple to set, simple to use, simple to manufacture, and very cost effective.

Figure 6:
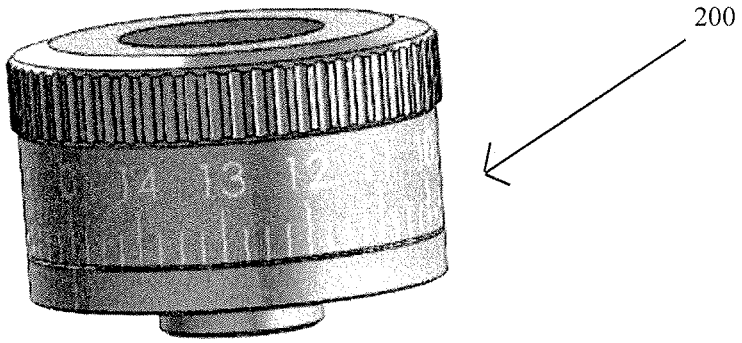
FIG. 6 is a representative assembled view of the turret disclosed herein.

FIG. 6 is an assembled view of the turret 200. The outside of the turret knob has indications or markings. In one embodiment, numbers are present on the outside of the turret knob and are visible to the user. In one embodiment, there are fourteen (14) numbers present on the outside of the turret knob, which are visible to the user.

In another embodiment, there are four markings between each number on the outside of the turret knob. In one embodiment, the marking are hash marks.

Figure 7:
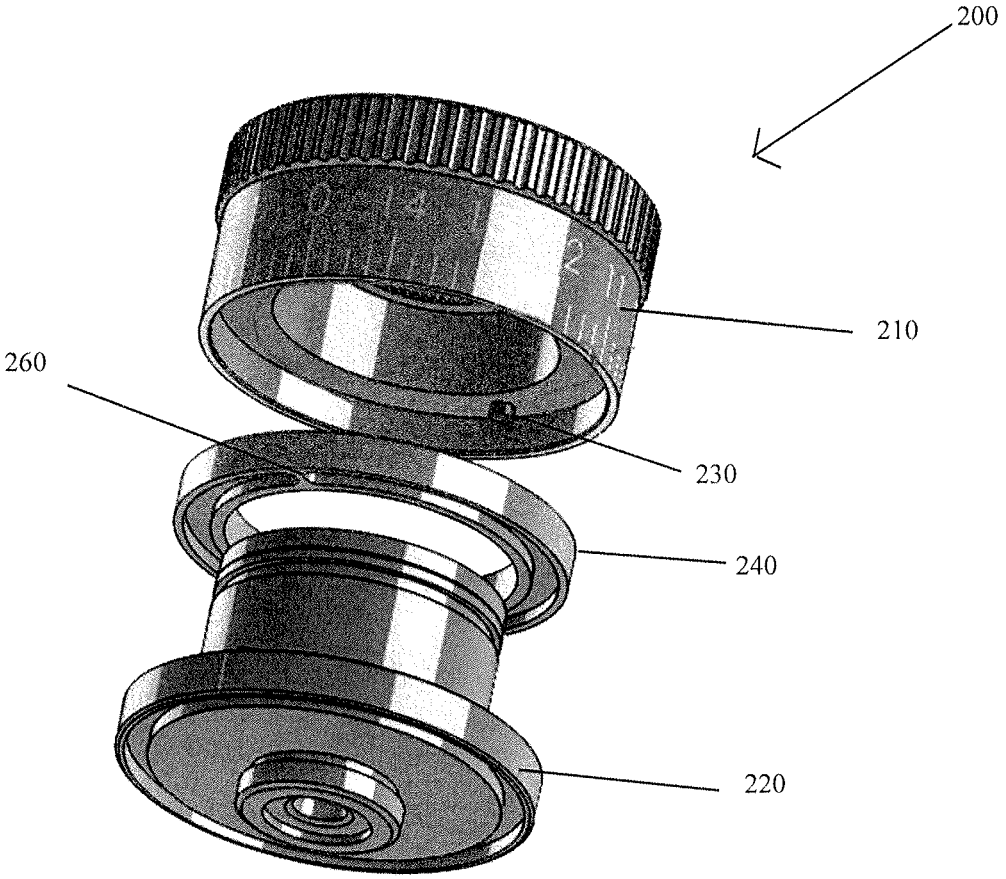
FIG. 7 is a representative exploded view of a turret disclosed herein. The terminated ends of the ring are shown.

FIG. 7 is an exploded view of a turret described herein illustrating the terminated ends 260. The turret 200 has a zero stop ring 240 with a concentric cam-track on each side of the ring. The cam-track on each side of the ring 240 has terminated ends 260. In FIG. 7, the terminated ends are slightly off-set. As the zero stop ring has a track or groove on each side, the terminated ends are slightly off-set to allow for maximum rotation.

In yet another embodiment, the turret comprises: (1) a turret knob with a pin located at the bottom; a zero stop ring with a groove on the top side and pin on the bottom side; and with a turret base with a groove or track on the top portion of the turret base. The pin can be located along the inner perimeter or on the outer perimeter. The pin can be permanently affixed or removable. The pin can be a single piece or multiple pieces.

Figure 8:
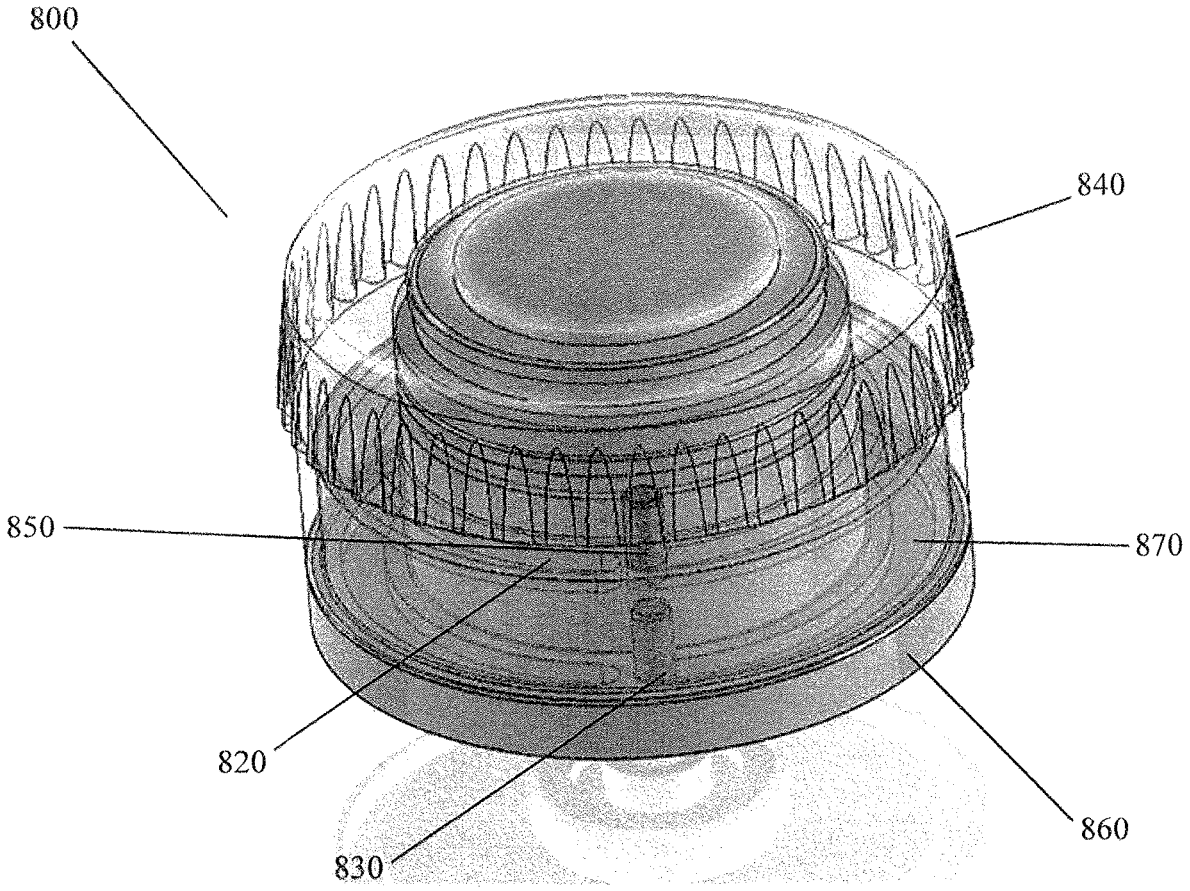
FIG. 8 is a representative view of a turret disclosed herein. A pin is coupled to the turret knob. The ring has a track or groove on the top side and a pin coupled to the underside of the ring. The top portion of the turret base a grove to accept the pin coupled to the underside or bottom of the ring.

FIG. 8 is a cut-away of a turret 800 having a ring with one grove or track 820. The ring has one track 820 on the top side of the ring. The ring has a pin 830 on the bottom side of the ring. The bottom of the turret knob 840 has a pin 850. The pin 850 can be permanently attached or can be removable. The turret knob pin 850 rests in the grove or track 820 on the top side of the ring. The turret base 860 has a track 870 on the top side. The pin 830 on the bottom side of the ring rests in the track 870 on the top side of the turret base 860.

On the first rotation of the turret knob, the pin 850 that is coupled to the bottom of the turret knob 840 tracks around the groove 820 in the top of the zero stop ring, while the zero stop ring remains stationary. On the second revolution, the pin 850 that is coupled to the bottom of the turret knob 840 contacts the terminated end of the groove on the top 820 of the zero stop ring, thereby causing the zero stop ring to rotate.

On the second rotation, the pin 830 that is coupled to the bottom of the zero stop ring tracks around the groove 870 in the turret base 860. At the end of the second revolution, the pin 830 that is coupled to the bottom of the zero stop ring contacts the terminated end of the groove in the turret base 860, thereby stopping all rotation of the turret.

Figure 9:
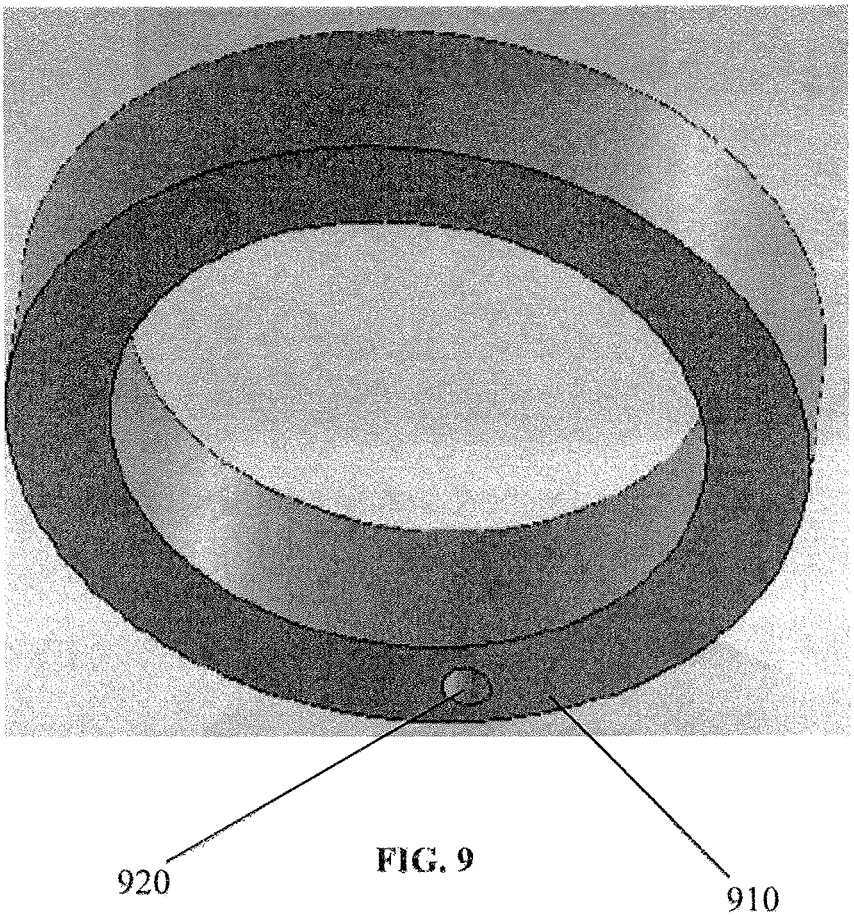
FIG. 9 is a representative view of a ring with a slot for insertion of a pin or similar structure.

FIG. 9 is a representative depiction of a ring 910 with a cavity 920 for a pin. The cavity 920 can be located on either side of the ring. Ring 910 can be used when either the turret knob or the turret base has a grove or track for acceptance of the pin.

Figure 10:
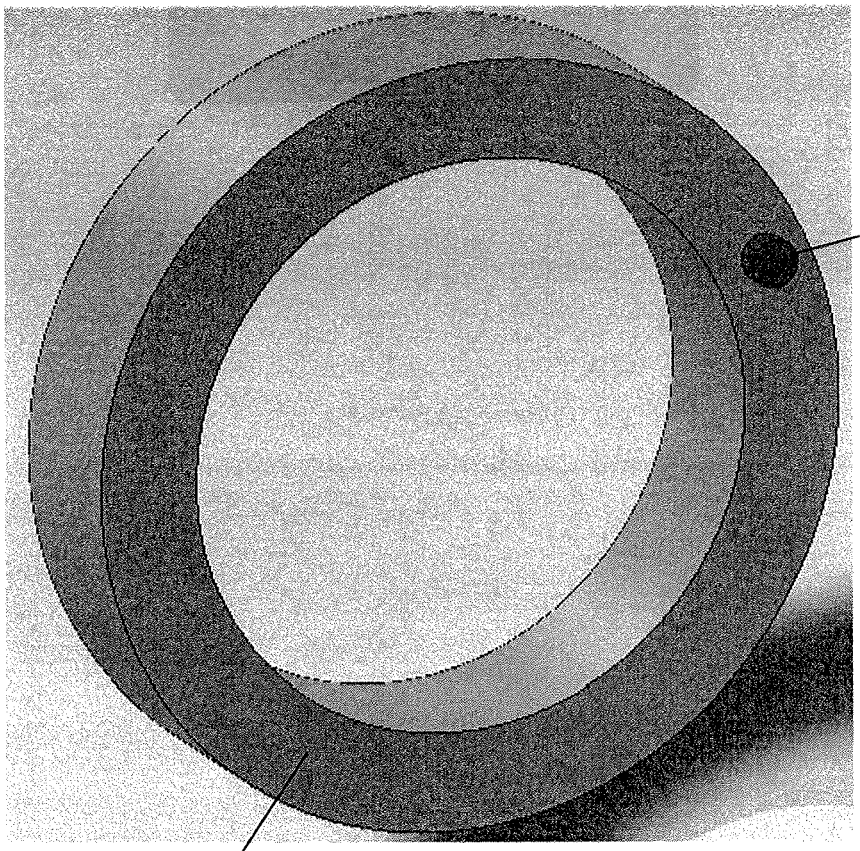
FIG. 10 is a representative view of a ring with a pin coupled to one side of the ring. A pin may be coupled to either side of the ring.

FIG. 10 is a view of the ring 910 with a pin 930 inserted into the cavity 920. The pin 930 can rest in a track or groove located on either another ring, a turret base or a turret knob.

In still another embodiment, a turret disclosed herein comprises: (1) a turret knob with a grove on the bottom of the turret knob; (2) a zero stop ring with a pin on the top side and groove on bottom side; and (3) a turret base with a pin.

In yet another embodiment, a turret disclosed herein comprises (1) a turret knob with a groove or track the bottom of the turret; (2) a zero stop ring with a pin on the top of the ring and on the bottom of the ring; and (3) a turret base with a groove or track on the top of the turret base.

In one embodiment, the groove or track on the bottom of the turret knob is located on the inside perimeter of the turret knob. In another embodiment, the groove or track on the top portion of the turret base is located on the inside perimeter of the turret base.

In another embodiment, the groove or track on the turret knob has a terminated end. In yet another embodiment, the groove or track on the turret base has a terminated end. In still another embodiment, the one or more groove or track on the zero stop ring has one or more terminated ends.

In still another embodiment, the terminated ends are off-set. In yet another embodiment, the terminated ends are offset to allow for the maximum amount of rotation of the turret.

In still another embodiment, the terminated ends are not off-set. In yet another embodiment, the terminated ends align with one another.

In one embodiment, the turret knob has one or more than one groove or track. In still another embodiment, the turret base has one or more than one groove or track.

In another embodiment, one or more zero stop rings can be used to obtain even more than 2 turns. This may be useful for competition, tactical, law enforcement, or military shooting where more turns/more travel are typically desired. In this embodiment, the zero stop ring would have a concentric cam track with terminated ends on one side and a fixed pin on the other side. The second zero stop ring would sit on top of the first zero stop ring and could have the opposite mating feature (concentric cam track or pin) to interface with the feature on the bottom zero stop ring. As long as the geometry of the terminated ends of the concentric cam track is designed properly, additional turns of the turret can be achieved before running out of travel while also allowing a solid zero stop at the user's zero position.

In one embodiment, when using more than one zero stop ring, it may be beneficial to use either (a) a zero stop ring with a groove or track on the top side and a pin on the bottom side; or (b) a zero stop ring with a pin on the top side and a groove or track on the bottom side.

Turrets and riflescopes disclosed herein are further described by the following paragraphs:

1. A device comprising: (a) a knob, (b) a ring with one or two tracks, wherein the one or two tracks are located on the top and/or bottom of the ring; and (c) a base, wherein at least the knob or base has a pin for insertion into the one or two tracks of the ring.

2. A device comprising: (a) a knob, (b) a zero stop ring with one or two tracks, wherein the one or two tracks are located on the top and/or bottom of the zero stop ring; and (c) a base, wherein at least the knob or base has a pin for insertion into the one or two tracks of the ring.

3. A device comprising: (a) a knob, (b) one or more rings with one or two tracks, wherein the one or two tracks are located on the top and/or bottom of the ring; and (c) a base, wherein at least the knob or base has a pin for insertion into the one or two tracks of the one or more rings, and further wherein the ring rests on the base and the knob and base are secured to one another.

4. The device of any one of the preceding paragraphs, wherein the ring has two tracks, wherein one track is located on the top of the ring and the second track is located on the bottom of ring.

5. The device of any one of the preceding paragraphs, wherein the knob has a pin on the bottom of the knob.

6. The device of any one of the preceding paragraphs, wherein the knob pin is located on the inner perimeter of the knob.

7. The device of any one of the preceding paragraphs, wherein the knob pin is located on the outer perimeter of the knob.

8. The device of any one of the preceding paragraphs, wherein the base has a pin located on the top portion.

9. The device of any one of the preceding paragraphs, wherein the base pin is located on the inner perimeter of the knob.

10. The device of any one of the preceding paragraphs, wherein the base pin is located on the outer perimeter of the knob.

11. The device of any one of the preceding paragraphs, wherein the one or two tracks are cam-tracks.

12. The device of any one of the preceding paragraphs, wherein the one or two tracks on the ring have terminated ends.

13. The device of any one of the preceding paragraphs, wherein the one or two tracks on the ring have terminated ends that are offset to allow maximum rotation of the knob.

14. The device of any one of the preceding paragraphs further comprising a second ring with one or two tracks, wherein the one or two tracks are located on the top and/or bottom of the ring.

15. The device of any of the preceding paragraphs, wherein the ring has one track or groove on the top side of the ring.

16. The device of any of the preceding paragraphs, further wherein the ring has a pin located on the bottom side of the ring.

17. The device of any of the preceding paragraphs, further wherein the knob has a pin on the bottom.

18. The device of any of the preceding paragraphs, further wherein the knob pin rests inside the track or groove on the top side of the ring.

19. The device of any of the preceding paragraphs, further wherein the base has a groove or a track on the top side.

20. The device of any of the preceding paragraphs, further wherein the ring pin located on the bottom side of the ring rests inside the groove or track on the top side of the base.

21. The device of any of the preceding paragraphs, wherein the ring has one track or groove on the bottom side of the ring.

22. The device of any of the preceding paragraphs, further wherein the ring has a pin located on the top side of the ring.

23. The device of any of the preceding paragraphs, further wherein the knob has a groove or track on the bottom.

24. The device of any of the preceding paragraphs, further wherein the ring pin located on the top side of the track or groove rests in the groove or track on the bottom of the knob.

25. The device of any of the preceding paragraphs, further wherein the base has a pin on the top side.

26. The device of any of the preceding paragraphs, further wherein the base pin located on the top side of the base rests inside the groove or track on the bottom of the ring.

27. The device of any of the preceding paragraphs, wherein the device is a turret.

28. The device of any of the preceding paragraphs, wherein the device is a windage turret.

29. The device of any of the preceding paragraphs, wherein the device is an elevation turret.

30. The device of any of the preceding paragraphs, wherein the device is a turret assembly.

31. A riflescope comprising a device of any of the preceding paragraphs.

32. A device comprising:

a knob with a pin coupled to the bottom of said knob;

a base with a pin coupled to the top portion of the base; and a stop ring with a concentric cam-track with terminated ends on each face of said stop ring, wherein the base pin rides in the concentric cam-track on the bottom of the zero stop ring, and the knob pin rides in the concentric cam-track on the top of the zero stop ring.

33. A device comprising:

a knob with a pin coupled to the bottom side of said knob;

a base with a track or groove on the top side of the base;

a ring with a track or groove on the top side and a pin on the bottom side; wherein the knob pin rests in the track or groove on the top side of the ring and the pin on the bottom side of the ring rests in the track or grove on the top side of the base.

34. The device of paragraph 31 wherein the ring is a zero stop ring.

35. The device of paragraph 31 wherein the track or groove on the base is a concentric cam-track.

36. The device of paragraph 31, wherein the track or groove on the base is a concentric cam-track with a terminated end.

37. The device of paragraph 31, wherein the track or groove on the top side of the ring is a concentric cam-track.

38. The device of paragraph 31, wherein the track or groove on the top side of the ring is a concentric cam-track with a terminated end.

39. The device of paragraph 31, wherein the track or groove is located on the inner perimeter of the top of the base.

40. A device comprising:

a knob with a track or groove coupled to the bottom side of said knob;

a base with a pin on the top side of the base;

a ring with a pin on the top side and a track or groove on the bottom side; wherein the ring pin rests in the track or groove on the top side of the knob and the base pin rests in the track or grove on the bottom side of the ring.

41. The device of paragraph 37, wherein the ring is a zero stop ring.

42. The device of paragraph 37, wherein the track or groove on the knob is a concentric cam-track.

43. The device of paragraph 37, wherein the track or groove on the knob is a concentric cam-track with a terminated end.

44. The device of paragraph 37, wherein the track or groove on the bottom of the ring is a concentric cam-track.

45. The device of paragraph 37, wherein the track or groove on the bottom of the ring is a concentric cam-track with a terminated end.

46. The device of paragraph 37, wherein the track or groove is located on the inner perimeter of the bottom of the knob.

47. A device comprising: a knob with a pin coupled to the bottom side of said knob; a base with a pin coupled to said base; and a stop ring with a concentric cam-track with terminated ends on each face of said stop ring.

48. The device of any of the preceding paragraphs, wherein the knob can make nearly two full rotations.

49. The device of any of the preceding paragraphs, wherein the knob can make two full rotations.

50. A rifle scope comprising: a scope body; a movable optical element defining an optical axis, the optical element being operably connected to the scope body; a turret having a screw operably connected to the optical element for adjusting the optical axis in response to rotation of the screw; the turret comprising (a) a knob, (b) a ring with one or two tracks, wherein the one or two tracks are located on the top and/or bottom of the ring; and (c) a base, wherein at least one of the knob or base has a pin for insertion into the one or two tracks of the ring.

51. A rifle scope comprising: a scope body; a movable optical element defining an optical axis, the optical element being operably connected to the scope body; a turret having a screw operably connected to the optical element for adjusting the optical axis in response to rotation of the screw; the turret comprising: a knob with a pin coupled to the bottom side of said knob; a base with a track or groove on the top side of the base; a ring with a track or groove on the top side and a pin on the bottom side; wherein the knob pin rests in the track or groove on the top side of the ring and the pin on the bottom side of the ring rests in the track or grove on the top side of the base.

52. A rifle scope comprising: a scope body; a movable optical element defining an optical axis, the optical element being operably connected to the scope body; a turret having a screw operably connected to the optical element for adjusting the optical axis in response to rotation of the screw; the turret comprising: a knob with a track or groove coupled to the bottom side of said knob; a base with a pin on the top side of the base; a ring with a pin on the top side and a track or groove on the bottom side; wherein the ring pin rests in the track or groove on the top side of the knob and the base pin rests in the track or grove on the bottom side of the ring.

53. A rifle scope comprising: a scope body and a turret comprising (a) a knob, (b) a ring with one or two tracks, wherein the one or two tracks are located on the top and/or bottom of the ring; and (c) a base, wherein at least the knob or base has a pin for insertion into the one or two tracks of the ring.

54. A rifle scope comprising: a scope body and a turret comprising: a knob with a pin coupled to the bottom side of said knob; a base with a track or groove on the top side of the base; a ring with a track or groove on the top side and a pin on the bottom side; wherein the knob pin rests in the track or groove on the top side of the ring and the pin on the bottom side of the ring rests in the track or grove on the top side of the base.

55. A rifle scope comprising: a scope body and a turret comprising: a knob with a track or groove coupled to the bottom side of said knob; a base with a pin on the top side of the base; a ring with a pin on the top side and a track or groove on the bottom side; wherein the ring pin rests in the track or groove on the top side of the knob and the base pin rests in the track or grove on the bottom side of the ring.

Example 1

Zeroing the Firearm

To set the zero at a given range, say 100 yards, the user would first mount the riflescope to their rifle. Then the user would shoot at the target. In between each shot, the user would adjust the turrets until their point of impact is right where they desired. Once the point of impact is at the desired position, the user would remove the outer turret knob, then rotate all of the zero stop rings to their full clock-wise position (it could be counter-clockwise if the turret screw pitch was in the opposite direction, which is sometimes desired in other countries) until the base pin contacts the terminated end on the zero stop bottom-side concentric cam track.

Next, the user would replace the turret knob with the "0" facing directly after so the knob pin would align into the "beginning" of the cam track on the top side of the zero stop ring. At this point the zero stop will not allow any more clockwise rotation ("downward" rotation) but only counter-clockwise rotation and it will allow almost 2 full turns of rotation. For a long range hunting scope anything over 24 MOA of travel will be sufficient for most situations and this zero stop will allow roughly 29 MOA. If this zero stop were to be used in longer range applications needing even more travel then a second zero stop ring or even more could be added to the design to allow additional rotations.

Example 2

In on configuration of the devices disclosed herein, on the first turn of the turret knob, the knob pin would ride inside the concentric cam track on the top-side of the zero stop ring. The zero stop ring remains stationary on the $1^{st}$ turn. When at the end of the first turn, the knob pin contacts the terminated end of the cam track so that when the second turn begins the knob AND the zero stop ring rotate together. On the second turn, the base pin tracks around the concentric cam track on the bottom side of the zero stop ring until near the end of the second turn it contacts the terminated end of the bottom-side concentric cam track, thus stopping all motion of the turret. Reversing direction will allow the turret to return to its original position, or "zero stop."

Example 3

In one configuration of the devices disclosed herein, on the first turn the zero stop ring and the knob pin rotate together with the base pin tracking inside the bottom concentric cam track until it contacts the terminated end. At this point, starting the second turn, the knob pin would track around the concentric cam track on the top-side of the zero stop ring until contacting the terminated end near the end of the second rotation.

Although specific embodiments have been illustrated and described herein, it will be appreciated by those of ordinary skill in the art that any arrangement that is calculated to achieve the same purpose may be substituted for the specific embodiments shown. This application is intended to cover any adaptations or variations that operate according to the principles of the invention as described. Therefore, it is intended that this invention be limited only by the claims and the equivalents thereof. The disclosures of patents, references and publications cited in the application are incorporated by reference in their entirety herein including but not limited to U.S. Pat. Nos. 9,435,609; 8,919,026; 8,397,420; and 8,166,696.

What is claimed is:

1. A turret comprising:

a knob with a first pin coupled to the bottom of said knob;

a base with a track on the top of said base, wherein the track of the base has terminated ends;

a ring with a track on the top and a second pin on the bottom; wherein the track of the ring has terminated ends, and further wherein the first pin rests in the track on the top of the ring and the second pin on the bottom of the ring rests in the track on the top of the base.

2. The turret of claim 1, wherein the track of the base is a concentric cam track.

3. The turret of claim 2, wherein the concentric cam-track is off-set to allow maximum rotation.

4. The turret of claim 1, wherein the track of the ring is a concentric cam-track.

5. The turret of claim 4, wherein the concentric cam-track of the ring is off-set to allow maximum rotation.

* * * * *